United States Patent [19]

Burke

[11] 4,205,594

[45] Jun. 3, 1980

[54] FLUID OPERATED APPARATUS

[76] Inventor: Martin F. Burke, 1618 Summit, Sioux City, Iowa 51103

[21] Appl. No.: 822,799

[22] Filed: Aug. 8, 1977

[51] Int. Cl.[2] ..... F01B 7/10

[52] U.S. Cl. ..... 92/65; 91/178; 92/151

[58] Field of Search ..... 92/62, 63, 65, 75, 151, 92/64, 150; 91/170 R, 178, 167 R

[56] References Cited

U.S. PATENT DOCUMENTS

| | | | |
|---|---|---|---|
| 2,506,374 | 5/1950 | McMahon | 92/62 |
| 2,531,907 | 11/1950 | Daubenmeyer | 92/75 |
| 3,312,146 | 4/1967 | Quéré | 92/62 |
| 3,713,364 | 1/1973 | Francia | 91/167 R |
| 4,002,105 | 1/1977 | Bell | 92/62 |

FOREIGN PATENT DOCUMENTS

| | | | |
|---|---|---|---|
| 79632 | of 1950 | Czechoslovakia | 92/62 |
| 2023704 | 11/1970 | Fed. Rep. of Germany | 92/151 |
| 1339103 | 10/1962 | France | 92/62 |
| 177791 | 1/1962 | Sweden | 92/151 |

*Primary Examiner*—Abraham Hershkovitz

*Attorney, Agent, or Firm*—Roylance, Abrams, Berdo & Farley

[57] ABSTRACT

A three position fluid actuated device including a cylinder, end walls, a central wall dividing the cylinder into two chambers and a stop midway in one chamber. A piston is slidable in the other chamber and is attached to one end of an output shaft which extends beyond the opposite end wall. Two floating pistons are slidable on the shaft in the one chamber on opposite sides of the stop. A snap ring on the shaft displaces the floating pistons toward the central and end walls. Four ports in the end and central walls permit moving the shaft to three positive positions.

5 Claims, 5 Drawing Figures

FLUID PRESSURE SOURCE

FLUID OPERATED APPARATUS

This invention relates to fluid actuated piston and cylinder apparatus and particularly to such an apparatus capable of assuming multiple positions with no need for springs or pressure balancing.

BACKGROUND OF THE INVENTION

There are many applications in industry in which it is desirable to have a pneumatically actuated piston and cylinder structure which is capable of assuming several positions wherein the positions are precisely defined and exactly repeatable. An example of the use of such a device is in the positioning of a mechanical transmission as set forth in U.S. Pat. No. 3,945,265, Bell et al, which issued on Mar. 23, 1976.

The prior art includes various examples of work in this general area, including the above-mentioned Bell et al patent and divisions thereof, as well as the following U.S. Pat. Nos.:

787,479 Tanner
787,480 Tanner
1,372,227 Huggins
1,810,399 Horni
2,137,961 Vorech
2,192,621 Radtke
2,297,026 Sanford
2,244,092 Wheeler
2,506,374 McMahon
2,508,564 Cardwell et al
2,531,907 Daubenmeyer
3,713,364 Francia With the exception of the Bell et al patent, it is believed that all of these references require either pressure balancing to establish one or more of the positions, or require springs for that purpose, or both. While it is certainly possible to use pressure balancing or multiple pressures to establish multiple piston positions, it is very difficult and requires relatively complicated equipment to be sure that the balance point remains the same each time. Clearly, if it does not, the precise location of the position determined by the balance point is not reliably repeatable. Essentially the same disadvantage is true of springs, in addition to the expense and limited life thereof.

The Bell et al structure therefore represents a significant contribution to the art in that multiple positions can be reached without balancing or springs. There are, however, certain complexities in that structure which make production thereof relatively expensive.

BRIEF DESCRIPTION OF THE INVENTION

An object of the present invention is to provide an improved piston and cylinder apparatus capable of moving an output shaft to any one of three possible longitudinal positions.

A further object is to provide an improved apparatus of the foregoing type which operates with a single pressure source.

Yet another object is to provide an improved fluid actuated device operable from a single pressure source selectively feeding four ports and using no pressure balancing or springs.

Briefly described, the invention includes an improved fluid pressure operated apparatus selectively movable to three distinct positions comprising a generally cylindrical hollow body having a central axis, first and second end walls at opposite ends of said body, a fixed central wall between said end walls dividing the hollow interior thereof into first and second chambers, a stop member attached to and extending inwardly from said body into said second chamber between said central wall and said second wall, a first piston in said first chamber, said first piston being axially slidable between said first wall and said central wall, an output shaft fixedly attached to and axially movable with said first piston, said shaft extending through said central wall, said second chamber and said second wall, a second piston axially slidable in said second chamber between said central wall and said stop member, said second piston having a central opening in sliding engagement with said shaft, a third piston axially slidable in said second chamber between said stop member and said second wall, said third piston having a central opening in sliding engagement with said shaft, means fixedly attached to said shaft between said second and third pistons for contacting said second and third pistons, first and second port means at said first and second end walls, respectively, for permitting flow of fluid under pressure to and from the chambers adjacent thereto, and port means at said central wall for permitting flow of fluid under pressure to and from said first and second chambers.

In order that the manner in which the foregoing and other objects are attained in accordance with the invention can be understood in detail, a particularly advantageous embodiment thereof will be described with reference to the accompanying drawings, which form a part of this specification, and wherein.

Figures 1, 2, 3, 4, 5:
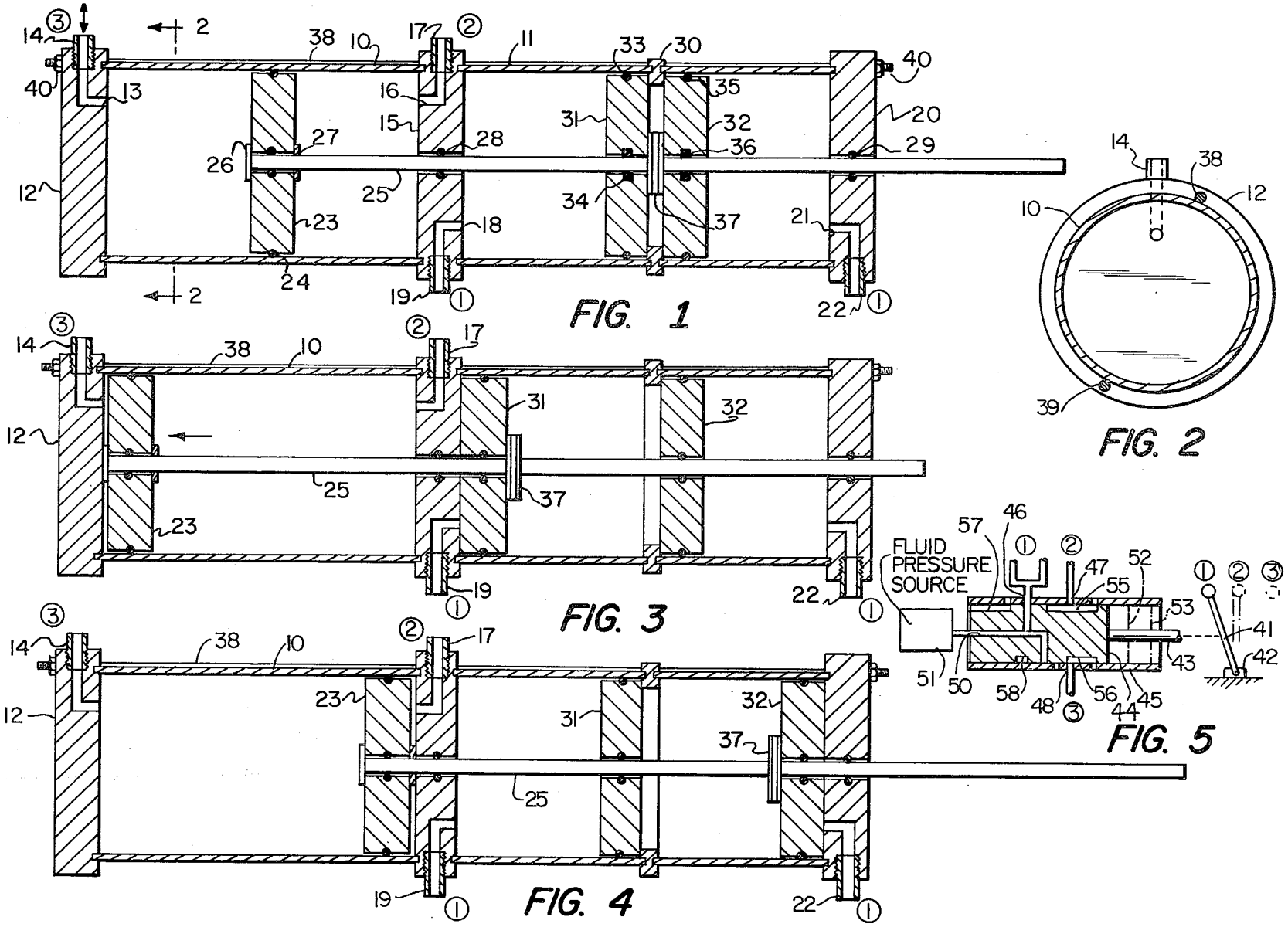
FIG. 1 is a side elevation, in partial longitudinal section, of a piston and cylinder apparatus in accordance with the invention, showing the apparatus in a first position.
FIG. 2 is a transverse section along lines 2—2 of FIG. 1.
FIG. 3 is a side elevation, in partial section, of the apparatus of FIG. 1 in a second position.
FIG. 4 is a side elevation, in partial section, showing the apparatus of FIGS. 1 and 3 in a third position.
FIG. 5 is a side elevation, partially schematic, showing a fluid pressure source and a valve usable with the apparatus of FIGS. 1–4.

It will be recognized by those skilled in the art that the apparatus of the present invention can be either hydraulically or pneumatically operated. However, it will be described in the context of a pneumatic apparatus for purposes of simplicity.

Referring first to FIG. 1, it will be seen that the apparatus includes a generally cylindrical body comprising a first tubular member 10 and a second tubular member 11 of substantially the same length as member 10. At one end of member 10 is a generally circular end wall 12 which is provided with an annular groove in one face to receive one end of tube 10. End wall 12 is also provided with a duct 13 leading from the interior of tube 10 to the ambient atmosphere, the outer portion of duct 13 being provided with a conventional fitting 14 to which a tubular pressure conduit of any conventional type can be attached.

At the other end of tube 10 is a central wall 15 which is provided in one end with an annular groove to receive the other end of tube 10 and is also provided, in its other face, with an annular groove to receive an end of tube 11. Wall 15 includes a duct 16 extending from the interior of tube 10 to the exterior of the body, the duct being provided with a fitting 17 to connect to a conduit. Also, wall 15 is provided with a duct 18 and a fitting 19, extending between the interior of tube 11 to fitting 19 to be connected to a conduit.

At the opposite end of tube 11 is a second circular end wall 20 which is similarly provided with an annular groove to receive the opposite end of tube 11 and is provided with a duct 21 and a fitting 22 to provide communication between the interior of tube 11 and a conduit connection to fitting 22. Slidably received within tube 10 is a piston 23 which is provided with an O-ring 24 or similar seal so that the piston can slide axially within the tube without permitting transfer of fluid between the chamber portions on the opposite sides of the piston. An output shaft 25 extends through a central opening in piston 23, the end of shaft 25 being fixedly attached to the piston as by threaded members or snap rings 26 and 27. As will be seen in FIG. 1, walls 15 and 20 are also provided with central openings and O-rings 28 and 29 so that output shaft 25 can extend therethrough in a sealing relationship, again preventing the transfer of fluid across these walls. The output shaft is axially slidable through these central openings.

It will be observed that in some circumstances the O-rings will not be necessary and that a journal fitting of suitable sealing tightness can be provided without such devices. However, in a device which is operated by hydraulic fluid, the sealing devices will probably be necessary.

A stop member 30 is provided in the chamber defined by tube 11 and walls 15 and 20. In the embodiment shown, stop member 30 comprises an annular body dividing tube 11 into two portions, this annular body having grooves to receive these two portions in a manner similar to wall 15. The stop member protrudes radially inwardly at about the midpoint of tube 11 but does not interfere with the action of output shaft 25. On either side of stop member 30 is a floating piston, these being identified as pistons 31 and 32. Piston 31 is provided with a sealing O-ring 33 around its periphery to engage the interior surface of tube 11 and an O-ring 34 surrounding output shaft 25. Similarly, piston 32 has a peripheral O-ring 35 and an interior O-ring 36 engaging shaft 25. As will be observed, both of pistons 31 and 32 are axially slidable within tube 11 and are also axially slidable relative to the output shaft.

Output shaft 25 is also provided with a stop member 37 which can constitute a snap ring or threaded member but, in any event, is fixedly attached to shaft 25 between pistons 31 and 32. As will be recognized, any axial movement of the output shaft and member 37 will cause movement of either one of pistons 31 and 32. Similarly, if member 37 is displaced from the position, movement of either piston against the stop member will cause movement of the output shaft.

As seen in FIG. 2, and as partially seen in FIGS. 1, 3 and 4, end walls 12 and 20 are held together by axially extending rods 38 and 39 which pass through the end walls and which have threaded ends protruding beyond those walls. Axial force is applied to the end walls by means such as nuts 40.

It will also be recognized that the various ducts and fittings which permit flow of fluid under pressure, or the application of pressure to the chambers, can be provided in various ways and need not extend through the walls in the exact manner shown. However, it is believed that the manner of forming the ducts in the walls is particularly desirable because of the saving of space within the chambers, particularly as to central wall 15.

The three positions which the apparatus of the present invention can assume are shown respectively in FIGS. 1, 3 and 4. Fluid pressure can be supplied to the fittings by any suitable valve mechanism, a simple form of which is shown in FIG. 5. As shown therein, a simple operating lever 41 is pivotally attached to a fixed frame member 42 and mechanically connected to a control shaft 43 which axially slides the piston 44 of a valve, piston 44 being slidable within a sleeve 45 having ducts 46, 47 and 48 which are connectable to the fittings of the apparatus of FIGS. 1–4. As illustrated therein, duct 46 is intended to be connected to fittings 19 and 22; duct 47 is intended to be connected to fitting 17; and duct 48 is intended to be connected to fitting 14. In order to correlate the positions of lever 41, the ducts of the valve and the fittings of the piston and cylinder apparatus, those ducts which apply pressure to the fittings to move the apparatus to the first position are labeled with the circled numeral 1, the duct which feeds the fitting to move to position 2 (fitting 17) and the fitting and lever are labeled 2, and duct 48 and fitting 14 are labeled 3.

Piston 44 is provided with a central axially extending duct 50 which is connected through a suitable conduit to a fluid pressure source 51, duct 50 having radial portions which are positioned to supply fluid under pressure to ducts 46, 47 and 48, respectively, in the first, second and third axial positions thereof. As will be seen from the dashed lines in FIG. 5, the right-hand end of piston 44 moves to the position identified as 52 and 53 as the lever is moved from position 1 to postions 2 and 3. Thus, as the piston resides in the position shown, pressure is applied to fittings 19 and 22, and fittings 14 and 17 are vented to the atmosphere through ducts 47 and 48 and recesses 55 and 56, respectively, in piston 44 and then through openings in sleeve 45. When the piston is in the second position with its end at 52, duct 50 is connected through the lower portion thereof to duct 48 and fitting 14, recess 56 being no longer connected to duct 48. Fittings 19 and 22 are vented through duct 46 which is now aligned with recess 57 and is therefore vented to the atmosphere. Similarly, duct 47 remains vented by recess 55 and its associated aperture through sleeve 45.

In the third position with the end of the piston at 53, the upper leg of duct 50 is connected to duct 47, ducts 46 and 48 being vented, the latter through recess 58. As will be recognized, any operative three-position control valve capable of supplying pressure selectively to three ports and venting the ports not pressured can be employed, the example of FIG. 5 being supplied only for the sake of completeness.

Turning now to the operation of the apparatus of FIGS. 1–4, as pressure is applied to the position 1 vents 19 and 22, pistons 31 and 32 are caused to move toward each other, this being the result of the pressure applied to the left-hand face of piston 31 and the right-hand face of piston 32. In moving toward each other, regardless of any prior positions, these pistons move until they encounter stop member 30 at which time motion ceases. In the process of moving to this position, either one of the pistons, depending upon the prior position of the apparatus, will contact member 37 fixedly attached to shaft 25 and move that member into alignment with stop member 30, thereby also necessarily moving the shaft to the position shown. This constitutes the first position of the apparatus which is, as described, positively assumed without any pressure balancing involved.

It will be recognized that the axial dimension of member 37 should be exactly equal to the axial dimension of stop member 30 in order for the first position to be precisely repeatable each time the apparatus is actuated. It will also be observed that the ports not specifically pressurized are vented.

When pressure is applied to fitting 17 in the second position of lever 41, the other fittings being vented, that pressure is applied to the right-hand face of piston 23, causing that piston to move to its extreme left-hand position, as shown in FIG. 3. In so moving, member 37 abuts the right-hand face of piston 31 and carries the piston with it, moving that piston to its extreme left-hand position. Thus, the output shaft is retracted to the greatest extent possible with the apparatus shown, this being the second position thereof. Piston 32 is floating in this position and plays no part therein.

The third position is shown in FIG. 4 and occurs when pressure is applied to vent 14 in the third position of the lever. In this condition, pressure is applied to the left-hand face of piston 23, causing that piston to move to its extreme right-hand position in which the output shaft is fully extended. In moving to this position, stop member 37 carries piston 32 to its extreme right-hand position and piston 31 is floating. As illustrated in FIG. 4, piston 31 may be carried by its frictional engagement with the shaft to its position adjacent stop member 30, but such movement is incidental to the overall operation of the device and is not of particular consequence.

If pressure is again applied in the position 1 situation illustrated in FIG. 1, pistons 31 and 32 are again moved to a position adjacent stop member 30, as illustrated. While these positions have been described in a particular sequence with reference to sequential numbers, it must be recognized that there is no requirement that the position be assumed in this sequence, and the sequence is chosen only for purposes of discussion and illustration. Thus, the apparatus could be caused to go between the positions shown in FIGS. 3 and 4, repeatedly.

While one advantageous embodiment of the invention has been illustrated in detail, it will be recognized by those skilled in the art that various modifications can be made therein without departing from the scope of the appended claims.

What is claimed is:

1. An improved fluid pressure operated apparatus selectively movable to three distinct positions comprising a generally cylindrical hollow body having a central axis;

first and second end walls at opposite ends of said body;

a fixed central wall between said end walls dividing the hollow interior thereof into first and second chambers;

a stop member attached to and extending inwardly from said body into said second chamber between said central wall and said second wall;

a first piston in said first chamber, said first piston being axially slidable between said first wall and said central wall;

an output shaft fixedly attached to and axially movable with said first piston, said shaft extending through said central wall, said second chamber and said second wall;

a second piston axially slidable in said second chamber between said central wall and said stop member, said second piston having a central opening in sliding engagement with said shaft;

a third piston axially slidable in said second chamber between said stop member and said second wall, said third piston having a central opening in sliding engagement with said shaft;

means fixedly attached to said shaft between said second and third pistons for contacting said second and third pistons;

first and second port means at said first and second end walls, respectively, for permitting flow of fluid under pressure to and from the chambers adjacent thereto; and third and fourth port means at said central wall for permitting flow of fluid under pressure to and from said first and second chambers, respectively;

said second and third pistons contacting said stop member and said means fixedly attached to said shaft to move said shaft to a first position when fluid is applied simultaneously under pressure to said second and fourth port means, said first piston moving said shaft to a second position when fluid is applied under pressure to said third port means, and said first piston moving said shaft to a third position when fluid is applied under pressure to said first port means, the remaining port means in each case being vented.

2. An apparatus according to claim 1 wherein said stop member comprises an annular member fixedly attached to and protruding inwardly from said body.

3. An apparatus according to claim 1, wherein the axial dimension of said means fixedly attached to said shaft is equal to the axial dimension of said stop member, whereby each of said second and third pistons entrap said means fixedly attached to said shaft while simultaneously contacting both said stop member and said means fixedly attached to said shaft in said first position to positively and precisely position said shaft without balancing the fluid pressures supplied to said second and fourth ports.

4. An apparatus according to claim 1, wherein said first and second chambers are of substantially equal axial length; whereby said second and third pistons contact said stop member and said means fixedly attached to said shaft to move said shaft to a first position when fluid is applied simultaneously under pressure to said second and fourth port means, said first piston moves said shaft to a second position when fluid is applied under pressure to said third port means, and said first piston moves said shaft to a third position when fluid is applied under pressure to said first port means, the remaining port means in each case being vented.

5. An apparatus according to claim 1, wherein said second and third pistons slide independently with respect to each other in said second chamber and on said shaft.

* * * * *